United States Patent [19]

Moodt

[11] 4,211,414

[45] Jul. 8, 1980

[54] WHEEDLE WHEEL GAME APPARATUS

[76] Inventor: John C. Moodt, 101 Loyola Cir., Enterprise, Ala. 36330

[21] Appl. No.: 19,304

[22] Filed: Mar. 12, 1979

[51] Int. Cl.[2] ..... A63F 5/04

[52] U.S. Cl. ..... 273/141 A; 46/238; 273/142 JB; 272/1 R

[58] Field of Search ..... 273/141 A, 141 R, 142 JB, 273/143 C, 1 M; 35/19 A; 46/237, 238, 239, 240, 241, 242; 40/426, 449; 116/204, 223, 224; 272/1 R, 8 R, 8 N

[56] References Cited

U.S. PATENT DOCUMENTS

| | | | |
|---|---|---|---|
| 813,082 | 2/1906 | Cottrell | 46/239 |
| 1,461,633 | 7/1923 | Stansbury | 273/141 A |
| 1,481,256 | 1/1924 | Dols | 46/238 |
| 2,323,837 | 7/1943 | Neal | 46/239 X |
| 2,719,718 | 10/1955 | Rothgery | 273/142 JB |
| 3,318,043 | 5/1967 | Abbott | 46/238 |
| 3,633,916 | 1/1972 | Thomas | 273/142 JB X |
| 3,759,524 | 9/1973 | McNaney | 273/142 JB X |
| 3,908,307 | 9/1975 | Jacobson | 46/238 |
| 4,011,674 | 3/1977 | Jacobson | 46/238 X |

FOREIGN PATENT DOCUMENTS

| | | | |
|---|---|---|---|
| 745911 | 3/1956 | United Kingdom | 273/142 JB UX |

*Primary Examiner*—Richard C. Pinkham
*Assistant Examiner*—Arnold W. Kramer
*Attorney, Agent, or Firm*—Jones, Thomas & Askew

[57] ABSTRACT

Novelty game apparatus for predictably and alterably selecting alternate activities. The apparatus comprises a base printed with indicia to indicate alternate activities. A pointer rotatably attached to the base alternately indicates one of the alternate activities. Magnets disposed on the base and the pointer operatively attract and repel the pointer to select a predetermined category of activities.

4 Claims, 3 Drawing Figures

WHEEDLE WHEEL GAME APPARATUS

TECHNICAL FIELD

The present invention generally relates to game apparatus; and more particularly to such game apparatus in which the results of the game are predictably alterable through the use of magnets.

BACKGROUND

Many different games and game apparatus are known which involve an element of chance. Magnets have also been used in game apparatus to accomplish various purposes.

U.S. Pat. No. 1,538,307 (incorporated hereby by reference) to Strehlow discloses a game for simulating bowling. The game includes a dial having various designations thereon and a spinner for randomly indicating one of the designations. The apparatus, however, has several disadvantages in that results of the game are not predictable and the spinner does not always point precisely to one of the designations.

U.S. Pat. No. 3,759,524 and British Pat. No. 194,020 (both incorporated herein by reference) disclose devices which solve the indexing problem of the Strehlow patent with the use of one or more magents. These devices, however, merely arrest the rotation of the rotatable discs used in tose devices at a plurality of consecutive predetermined locations. The magnets in no way affect the randomness of the selection process of these devices.

BRIEF DESCRIPTION OF THE INVENTION

Generally, the present invention relates to game apparatus utilizing magnets to affect the selection of alternate activities. More particularly, the game apparatus comprises a base having indicia on one surface thereof to divide the surface of the base into a plurality of first segmented areas and a plurality of second segmented areas. A pointer rotatably attached to the central portion of the base selectively indicates ones of the segmented areas. A plurality of magnets each having opposite poles of magnetic flux are disposed on the base and the pointer such that the pointer will only indicate segments of the first segmented areas. When the pointer is inverted, it will only indicate segments of the second segmented areas.

Accordingly, it is an object of the present invention t provide improved game apparatus.

Another object of the present invention is to provide game apparatus which produces predictably alterable results.

A further object of the present invention is to provide game apparatus which selects alternate activities.

These and other objects, features and advantages of the present invention will become apparent from a review of the following detailed description of the invention and the appended drawing and claims.

DETAILED DESCRIPTION OF THE DISCLOSED EMBODIMENT

Figure 1:
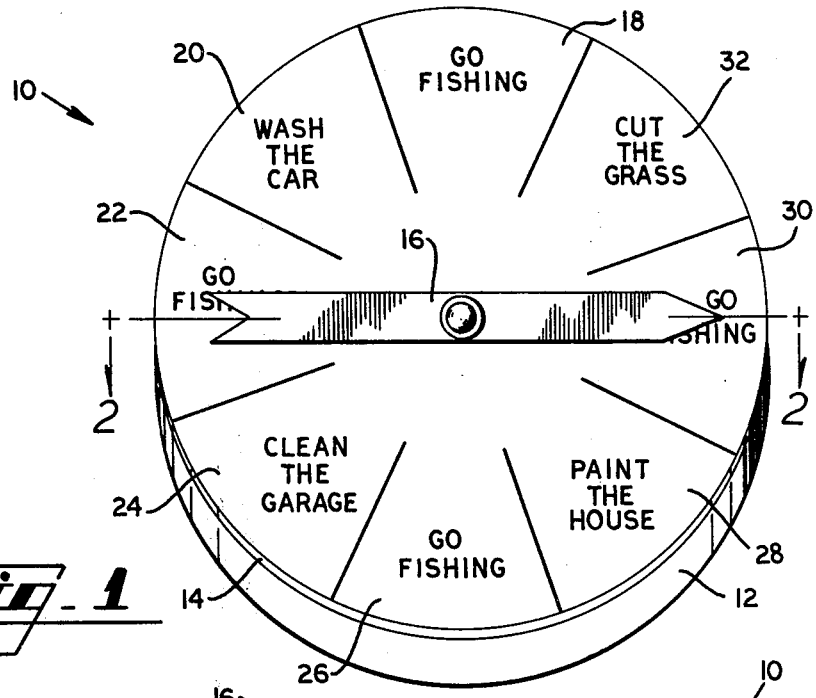
FIG. 1 is a pictoral view of a disclosed embodiment of the game apparatus of the present invention.
Figure 2:
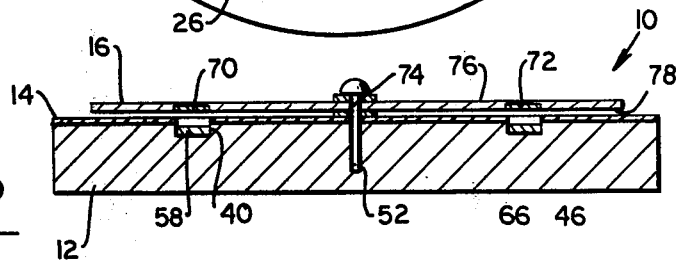
FIG. 2 is a cross-sectional view taken along the line 2—2 of the game apparatus shown in FIG. 1.
Figure 3:
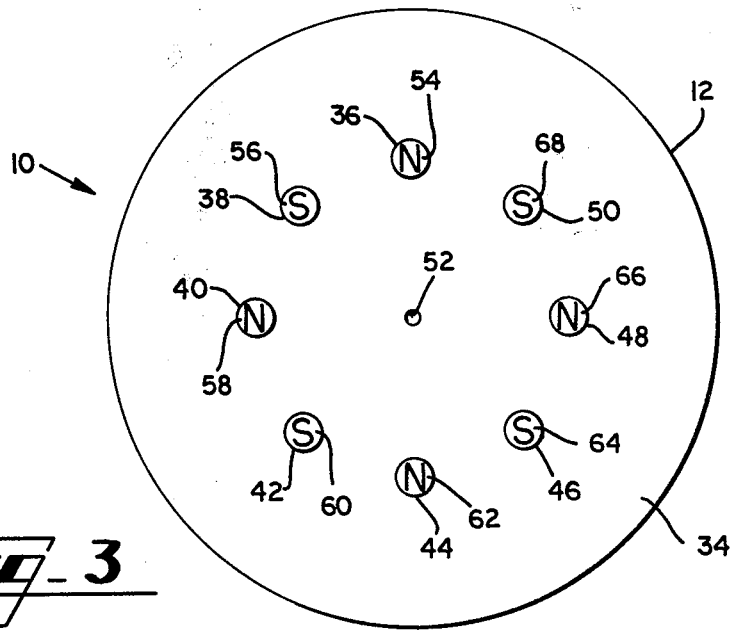
FIG. 3 is a top view of the game apparatus shown in FIG. 1 with the pointer and face plate removed.

Referring now to the drawing in which like numbers indicate like elements throughout the several views, it will be seen that there is a game apparatus 10 of a generally disk-like shape. The apparatus 10 comprises a base 12, a face plate 14 and a pointer 16.

The base 12 is made of a substantially rigid material such as wood, plastic, or the like. Although the base 12 is shown as being of a round shape, it is specifically contemplated that other suitable shapes may also be used.

Disposed on the top surface of the base 12 is a face plate 14 of essentially the same diameter as the base 12. The face plate 14 has indicia thereon, conveniently formed by printing or the like, to divide the face plate into eight triangular shaped segments 18–32. Each segment 18–32 has additional indicia thereon to designate an activity. Segments 18, 22, 26, 30 have the words "Go Fishing" thereon. Segments 20, 24, 28, 32 have the words "Wash the Car," "Clean the Garage", "Paint the House", and "Cut the Grass" respectively thereon. It will be readily appreciated that the eight segments 18–32 are divided into two categories; segments 18, 22, 26, 30 have one or omore desirable activities printed thereon and segments 20, 24, 28, 32 have one or more less desirable activities printed thereon. It will also be appreciated that other different activities may also be printed on the segments 18–32, such as, for example, go bowling, play golf, wash the dishes, or the like. It is contemplated that certain of the segments 18–32 be of one general classification and other of the segments be of another general classification. Furthermore, although the present invention is shown as having eight segments 18–32, it is specifically contemplated that other numbers of segments may be used.

It will be noted that the desirable activity segments 18, 22, 26, 30 are disposed on the fact plate 14 directly opposite each other and that the less desirable activity segments 20, 24, 28, 32 alternate therewith and are also disposed directly opposite each other. Although it is preferred to alternate the desirable activity segments with the less desirable activity segments, it is not a requirement of the present invention.

Formed in the top surface 34 of the base 12 are eight holes 36–50. The holes may be formed by any convenient means, such as by drilling, die casting and the like. Each hole 36–50 is spaced radially outwardly equal distances from a pin 52 which is the pivot point of the pointer 16. Additionally, each hole is essentially equally spaced angularly around the pin 52. It will be appreciated that there is one hole 36–50 for each segment 18–32 and that each segment of the face plate 14 is disposed directly above one of the holes.

Disposed in each hole 36–50 is a magnet 54–68. The magnets 54–68 are of a conventional type, such as ceramic-type magnets, having opposite poles of magnetic flux, commonly termed north and south poles. The magnets 54–68 are fitted into the holes 36–50 so as to be substantially flush with the top surface 34 of the base 12.

Although the present invention is shown as having magnets fitted into holes formed in the top surface 34 of the base 12, it is specifically contemplated that other methods of locating the magnets adjacent the segments 18–32 may be used. For example, the holes could be formed in the bottom surface of the base 12, or the base could be hollow with the magents attached to the underside thereof. In such a case, it may also be expeditious to eliminate the face plate 14 and print the indicia directly on the base.

The magnets 54, 58, 62, 66 are disposed in the holes 36, 40, 44, 48 in such a manner that one of the poles, for example the north pole, is facing upward. Conversely, the magnets 56, 60, 64, 68 are disposed in the holes 38, 42, 46, 50 in such a manner that the opposite pole, i.e., the south pole, is facing upwardly. It will therefore be appreciated that each segment 18–32 has associated therewith a magnetic field of particular polarity. It will also be appreciated that the polarity of the magnetic field associated with the desirable activity segments is opposite the polarity of the magnetic field associated with the less desirable activity segments.

The pointer 16 is made of an essentially rigid material, such as metal, plastic, or the like. Magnets 70, 72, also having opposite poles of magnetic flux, are flush fit adjacent the ends of the pointer 16. The magnets 70, 72 should also be spaced approximately equally from a hole 74 formed in the pointer 16 so that the pointer is reasonably well balanced about its intended point of rotation. The distance from the hole 74 to either of the magnets 70, 72 is also approximately equal to the distance from the pin 52 to any one of the magnets 54–68.

The pointer 16 has a top surface 76 and a bottom surface 78. The magnets 70, 72 are disposed on the pointer 16 is such a manner that one of the poles of both of the magnets is associated with the top surface 76 of the pointer and the opposite pole of both magnets is associated with the bottom surface 78 of the pointer.

It is specifically contemplated that the magnets 70, 72 may be disposed on the pointer 16 such that opposite poles of the magnets are associated with the top surface 76 of the pointer. Such disposition would be used if the magnets 54–68 were disposed on the base 12 such that magnets of opposite polarity were disposed directly opposite each other through the pin 52.

The pointer 16 is removably and rotatably attached to the pin 52. A nut secures the pointer to the pin 52 and washers disposed between the nut and the face plate 14 facilitate smooth rotation of the pointer about the pin.

It will be appreciated that as the pointer 14 is rotated about the pin 52, the magnets 70, 72 come into relatively close mutually confronting relationship with the magnets 54–68. Due to the fact that like magnetic poles repel and opposite poles attract, the pointer 16 will experience alternating forces of attraction and repulsion as it is rotated about the pin 52. It will therefore be recognized that as the speed of rotation of the pointer 16 is reduced the attractive forces will at some point arrest the motion of the pointer about a magnet 54–68 of opposite polarity to the polarity of the magnets 70, 72 confronting it. It will also be appreciated that if the pointer 16 is removed from the pin 52, inverted and reattached to the pin, the polarity of the magnets 70, 72 confronting the magnets 54–68 is opposite what it was previously. The pointer 16 will therefore react exactly opposite to the magnets 54–68 as it did previously; that is, the magnets which previously attracted the pointer now repel the pointer; and the magnets which previously repelled the pointer, now attract the pointer.

Use of the game apparatus 10 will now be considered. The game apparatus 10 is primarily intended for use as a novelty. One might wish to suggest to a companion that they should let the apparatus 10 decide what activity they should pursue for the day.

The apparatus 10 is operated by spinning the pointer 16 about the pin 52, typically with a flick of the finger. Which segment 18–32 the pointer 16 will stop on is determined by the surface 76, 78 of the pointer confronting the magnets 54–68. Therefore, a person knowing the orientation of the pointer 16 will know ahead of time the category of activity upon which the pointer will stop, and may either proceed to spin the pointer as it is configured or invert it to obtain opposite results.

It should be understood, of course, that the foregoing relates only to a preferred embodiment of the present invention and that numerous modifications or alterations may be made therein without departing from the spirit and scope of the invention as set forth in the appended claims.

I claim:

1. Apparatus for playing a game comprising:

a base having a central portion and a top surface, said top surface being marked with indicia to divide said top surface into a plurality of first segmented areas and a plurality of second segmented areas, said first and second segmented areas being alternately disposed about said central portion;

pointer means rotatably attached to said central portion of said base for selectively indicating one of said plurality of said first and second segmented areas, said pointer means having a first orientation and an inverted orientation; and a plurality of magnets, each having opposite poles of magnetic flux, said magnets being operatively disposed on said base and said pointer means such that said pointer means indicates only said first segemented areas when said pointer means is in said first orientation and said pointer means indicates only said second segmented areas when said pointer means is in said inverted orientation.

2. The apparatus of claim 1 wherein said pointer means comprises:

a pivot attached to said base, said pivot being attached to said base at said central portion of said base; and an arrow having a head portion, a tail portion, a first surface and a second surface, said arrow being rotatably attached to said pivot such that said head portion of said arrow selectively indicates one of said plurality of said first and second segmented areas, said arrow being attachable to said pivot such that said first surface of said arrow is adjacent said top surface of said base and alternately attachable to said pivot such that said second surface of said arrow is adjacent said top surface of said base.

3. The apparatus of claim 2, wherein each of said first segmented areas has one pole of at least one of said magnets associated therewith, each of said second segmented areas has the opposite pole of at least one of said magnets associated therewith, said first surface of said arrow has one pole of at least one of said magnets associated therewith and said second surface of said arrow has the opposite pole of at least one of said magents associated therewith.

4. Apparatus for playing a game comprises:

a base having a central portion and a top surface, said top surface being marked with indicia to divide said top surface into a plurality of first segmented areas and a plurality of second segmented areas;

a pivot attached to said central portion of said base;

a plurality of magnets having opposite poles of magnetic flux, said magnets being disposed on said base at equal distances radially outwardly from said pivot, each of said first areas having one pole of a magnet associated therewith, each of said second areas having the opposite pole of a magnet associated therewith;

a pointer rotatably and removably attached to said pivot, said pointer having a first surface and a second surface and each selectively disposable in confronting relation to said base top surface;

at least one magnet having opposite poles of magnetic flux disposed on said pointer, said magnet having one pole associated with said first surface of said pointer and the opposite pole associated with said second surface of said pointer; and said pointer is indexed only to said first segmented areas when said pointer is spun if said first surface is in said confronting relation and said pointer is indexed only to said second segmented areas if said second surface is in said confronting relation.

* * * * *